United States Patent [19]

Naka et al.

[11] Patent Number: 5,072,557

[45] Date of Patent: Dec. 17, 1991

[54] DEVICE FOR FIXING FLOOR PANELS

[75] Inventors: Hiromasa Naka; Norio Nakamura; Takehiko Okushima; Takao Okumura; Tatsuo Shoji; Tetsuo Tobikawa, all of Tokyo, Japan

[73] Assignee: Naka Corporation, Tokyo, Japan

[21] Appl. No.: 601,658

[22] Filed: Oct. 25, 1990

[51] Int. Cl.[5] ..... E04B 5/00

[52] U.S. Cl. ..... 52/126.6; 52/126.1; 52/263

[58] Field of Search ..... 52/126.1, 126.4, 126.5, 52/126.6, 126.7, 263, 506

[56] References Cited

U.S. PATENT DOCUMENTS 3,830,024 8/1974 Warnke ..... 52/126.7
4,546,580 10/1985 Ueno et al. .
4,922,670 5/1990 Naka et al. ..... 52/126.6

FOREIGN PATENT DOCUMENTS 3413446 10/1985 Fed. Rep. of Germany .

*Primary Examiner*—David A. Scherbel
*Assistant Examiner*—Robert Canfield
*Attorney, Agent, or Firm*—Wenderoth, Lind & Ponack

[57] ABSTRACT

A device for fixing floor panels mounted on a surface of a base floor by means of support legs which permit vertical adjustment of the floor panels is provided. The fixing device comprises a retainer plate fixed to the base floor for receiving the support legs therein; a support member extending vertically from the retainer plate and having an internally threaded portion; a panel holder; and a bearing member for the panel holder. The bearing member includes one end thereof threaded into the internally threaded portion of the support member for rotatable movement of the bearing member relative to the retainer plate. The bearing member is adapted to be accessible through the floor panels for operation thereof. The panel holder is adapted to be engageable with the bearing member in order to fix the floor panels.

11 Claims, 11 Drawing Sheets

Fig. 12
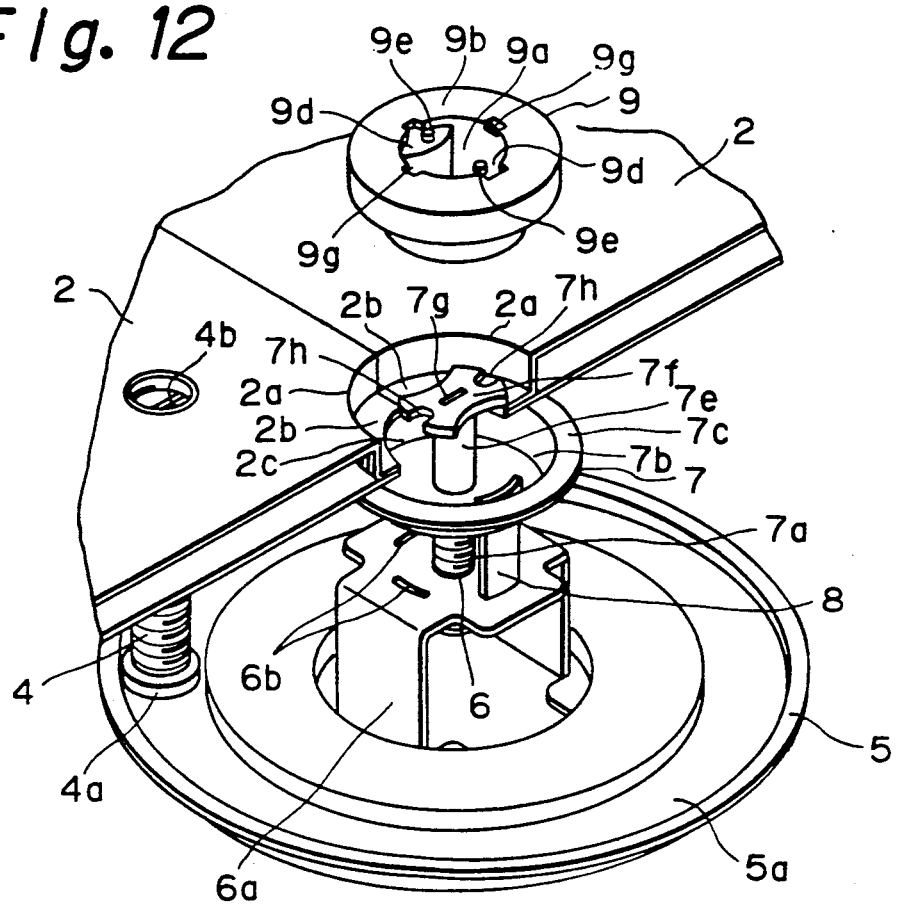
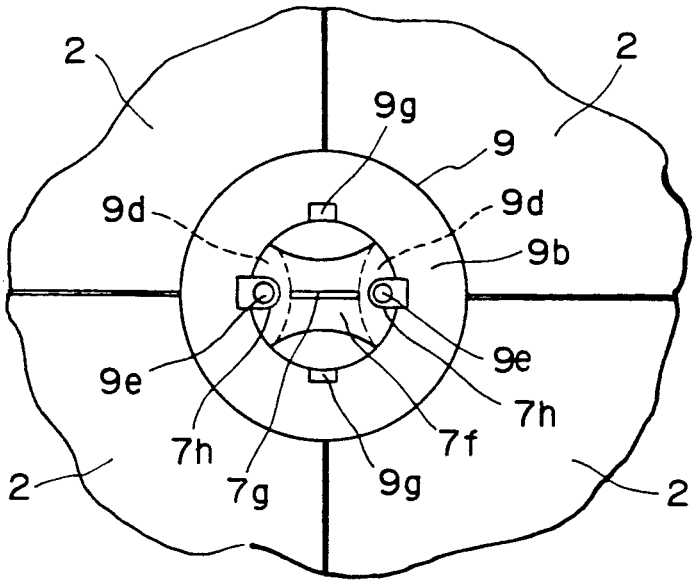
Fig. 13

DEVICE FOR FIXING FLOOR PANELS

BACKGROUND OF THE INVENTION

1. Field of the Invention

The present invention relates to a device for fixing floor panels. More particularly, the invention relates to a device for fixing floor panels mounted on a surface of a base floor by means of support legs which permit vertical adjustment of the floor panels by utilizing a panel holder and a bearing member for the panel holder.

2. Description of the Related Art

A double floored construction, i.e., a free access floor has been known. Such a free access floor is so constructed that floor panels are mounted on a surface of a base floor, such as a concrete floor, by means of support legs or stationary legs, whereby a free space may be provided between the floor panels and the base floor, the free space permitting easy distribution of electric cables and ventilation ducts.

Japanese Utility Model Public Disclosure (KOKAI) No. 53-123815 discloses a free access floor construction of an independent leg type in which floor panels are supported by a plurality of stationary legs formed separately from the floor panels. In this construction, a corner portion of each of the floor panels is disposed at the upper end of a stationary leg which is located at a predetermined position and extends upwardly. The floor panels may be easily supported and fixed by engaging a panel holder with the stationary leg by way of one touch manipulation. This fixing device includes, as shown in FIG. 12, a stationary leg A, an adjustment table C adapted to be adjustably movable in a vertical direction and which serves as a support for supporting a floor panel B at the upper portion of the stationary leg A, and an engagement bore D provided in the adjustment table. A flange portion F is formed at the upper end of a panel holder E, while an engagement portion G is formed at the lower end of the panel holder, the engagement portion G being adapted to be "engaged" when the engagement bore D is rotated by a predetermined amount. The engagement portion G of the panel holder E is inserted into the engagement bore D of the adjustment table C through a through hole H defined between the floor panels. When the panel holder E is rotated by a predetermined amount, the engagement portion G positioned in the engagement bore D engages within the engagement bore D and the flange portion F engages with a stepped portion I in the through hole H. In this manner, the panel holder fixes the floor panels B to the adjustment table C.

Apart from a free access floor having the above-mentioned construction, Japanese Patent Public Disclosure (KOKAI) No. 62-291361 discloses a free access floor of an integral leg type in which floor panels are supported by plural support legs disposed adjacent to corner portions of each of the floor panels. According to this construction, each support leg includes a support bolt disposed underneath the floor panel and are mounted on a base secured to a surface of a base floor. The vertical position of the floor panels may be adjusted by adjustably rotating the support legs.

The floor panel fixing device for use in the free access floor of the above independent leg type is so configured that the panel holder E can be easily mounted by one touch manipulation. The panel holder however includes a gap at the lower end thereof for allowing the panel holder to be rotatable within the engagement hole D of the adjustment table C and thus the panel holder and the adjustment table were not capable of being tightly or rigidly connected to one another. The prior art device also involves disadvantages in that it is difficult to adjust each corner portion of adjacent floor panels to a predetermined level due to irregularities of a floor base surface. Accordingly, it was difficult for the panel holder E according to prior art to be press-fitted between the floor panels B and the adjustment table C, and thus undesirable free movement of the floor panels could not be prevented. Furthermore, and with the construction of the above device, removal or detachment of the floor panels having been installed was unavoidable in order to perform readjustment of the level or height of the bearing members.

With regard to the device of an integral support leg type, it was likely that the support legs integral with the floor panels would require to be arranged at different levels due to irregularities or an incline in a base floor surface. Further, the support legs of the floor panels tended to move sideways thus creating an undesirable gap between the floor panels.

Furthermore, the panel holder of the above device for fixing floor panels can be easily fastened or loosened by means of a screw driver, for example, whereby an unrestricted open-close operation is permitted. In particular, and with regard to a corridor where many people may walk, it is likely that electric cables and/or equipment located below the floor panels might be damaged.

SUMMARY OF THE INVENTION

Accordingly, one object of the invention is to provide a floor panel fixing device which is capable of easily and firmly securing floor panels by means of one touch manipulation, and which also includes a mechanism permitting a level adjustment procedure for the panel holder to be carried out so as to fix the position of the panel holder at a predetermined level.

Another object of the present invention is to provide a device for fixing floor panels which includes a panel holder capable of being mounted to or dismounted from a bearing member of the panel holder solely by means of a special tool therefor, thereby preventing the floor panels from being easily or unintentionally opened or closed.

According to one aspect of the invention, a device for fixing floor panels mounted on a surface of a base floor by means of support legs which permit vertical adjustment of the floor panels comprises a retainer plate fixed to the base floor for receiving the support legs therein, a support member extending vertically from the retainer plate and having an internally threaded portion, a panel holder, and a bearing member for the panel holder, the bearing member having one end thereof threaded into the internally threaded portion of the support member to enable rotatable movement of the bearing member relative to the retainer plate, the bearing member being accessible through the floor panels for operation thereof, and the panel holder being adapted to be engageable with the bearing member for fixing the floor panels.

According to one embodiment of the invention, the fixing device further comprises a stopper for preventing rotation of the bearing member, the stopper adapted to be engaged with the retainer plate and the bearing member.

According to another embodiment of the invention, the panel holder is configured so as to be able to be engaged with the bearing member at a single touch.

In another aspect of the invention, a device for fixing floor panels mounted on a surface of a base floor by means of a panel holder having an inner flange portion and a bearing member having an engagement portion for engagement with a panel holder comprises a pin mounted on the inner flange portion of the panel holder for retractable movement thereof, and a notch formed in said engagement portion of the bearing member for engagement with the pin.

BRIEF DESCRIPTION OF THE DRAWINGS

Several embodiments according to the present invention will be explained hereinbelow with reference to the attached drawings, wherein:

FIG. 12 is an exploded perspective view illustrating a floor panel fixing device according to a fifth embodiment of the invention;

FIG. 13 is a plan view illustrating the device of FIG. 12 in an assembled condition;

DETAILED DESCRIPTION OF THE PREFERRED EMBODIMENTS

Figure 1:
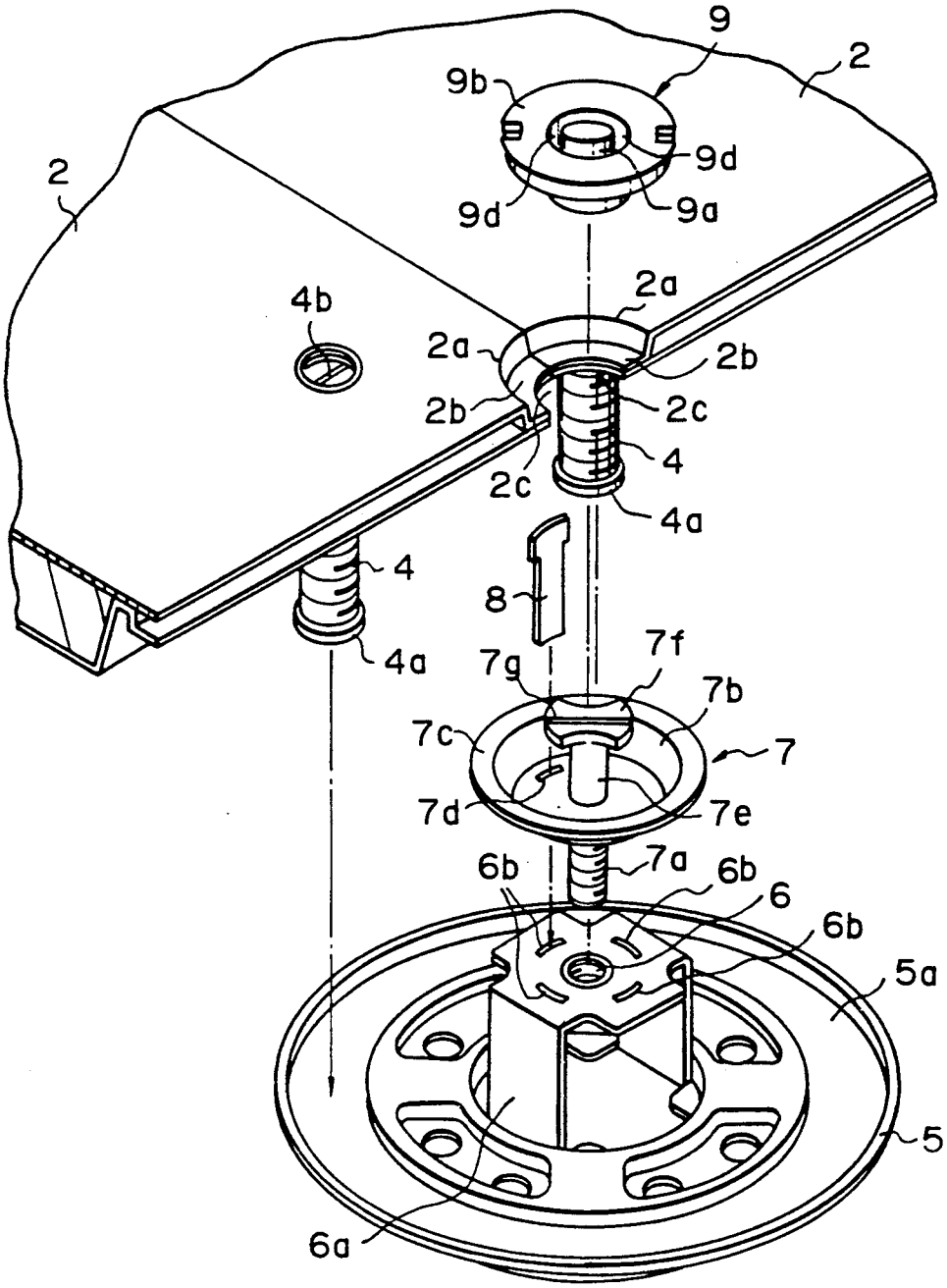
FIG. 1 is an exploded perspective view illustrating a floor panel fixing device according to a first embodiment of the invention.
Figure 2:
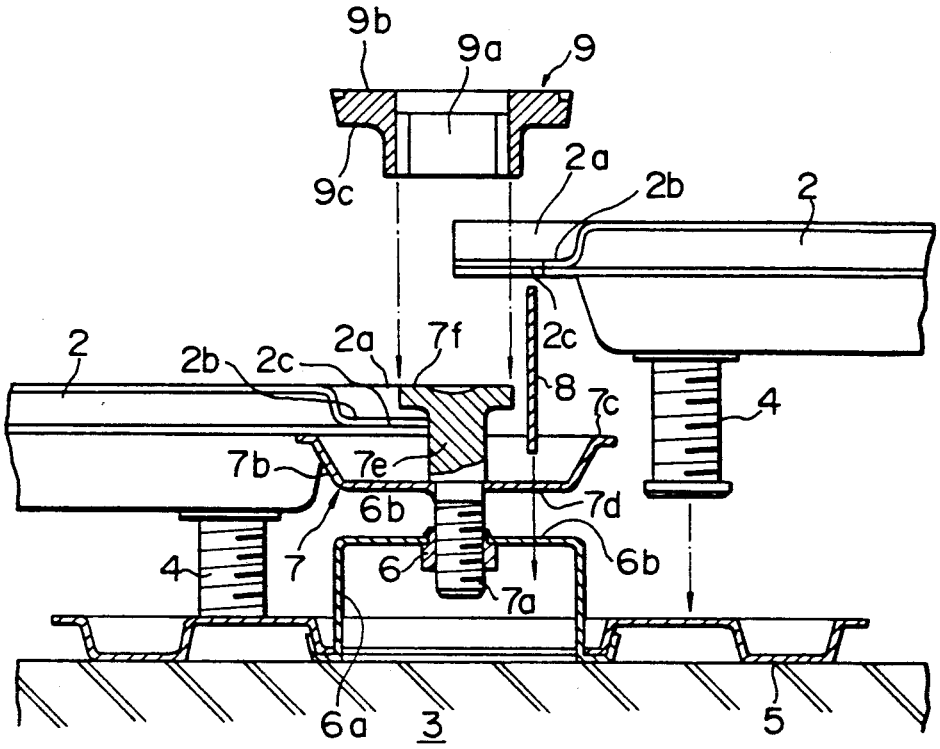
FIG. 2 is a cross-sectional view of the device shown in FIG. 1.
Figure 3:
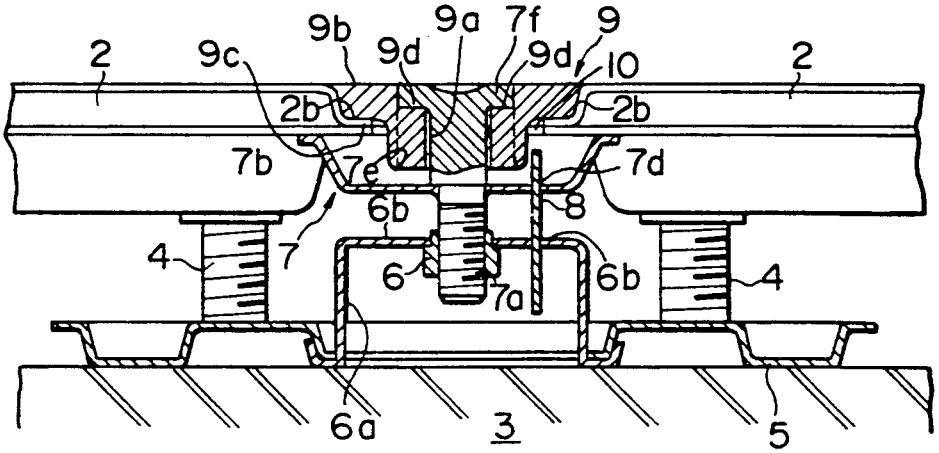
FIG. 3 is a cross-sectional view illustrating the device of FIG. 2 in an assembled condition.
Figure 4:
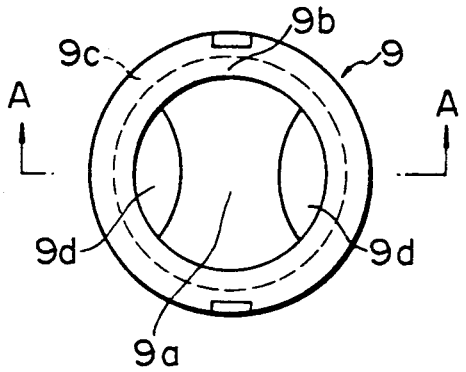
FIG. 4 is a plan view of a panel holder.

FIGS. 1 through 5 show a first embodiment of the invention. A floor panel fixing device includes a retainer plate 5 for receiving support legs 4 disposed at each of the four corners of each of floor panels 2 and having thereon a support member 6*a* extending upwardly therefrom and formed with an internally threaded portion 6, a bearing member 7 on the retainer plate 5 for threadingly engaging with the internal threaded portion 6, and a panel holder 9 cooperating with the bearing member to fix each corner of the portions 2*a* of the floor panels 2.

Figure 11:
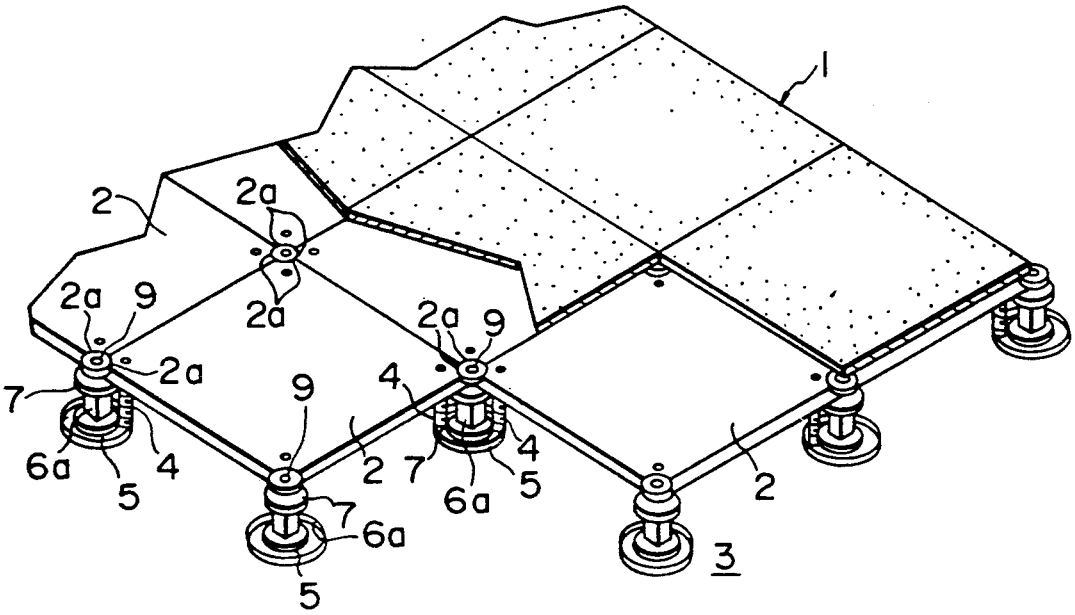
FIG. 11 is perspective illustration of a portion of a free access floor to which the device of the invention is mounted.
Figure 14:
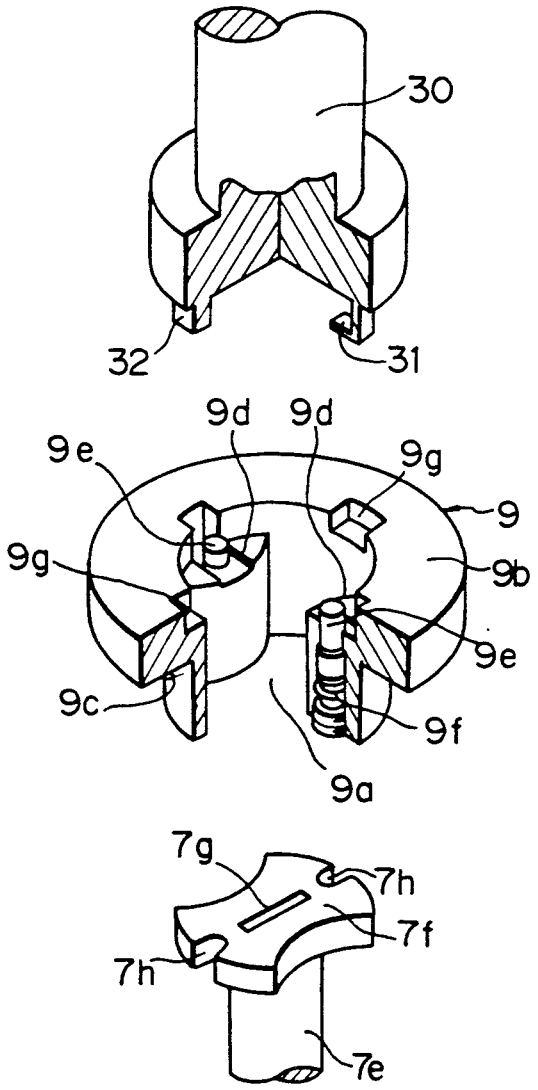
FIG. 14 is a perspective view of a main portion of the device of FIG. 12 with a part broken away.
Figure 15:
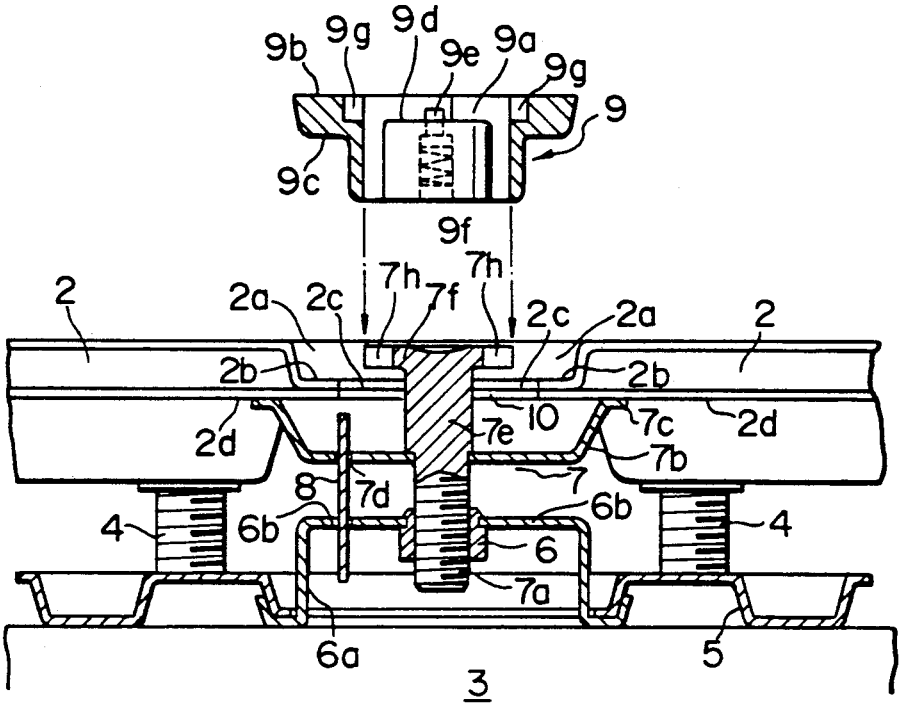
FIG. 15 is a cross-sectional view illustrating the device of FIG. 12.
Figure 16:
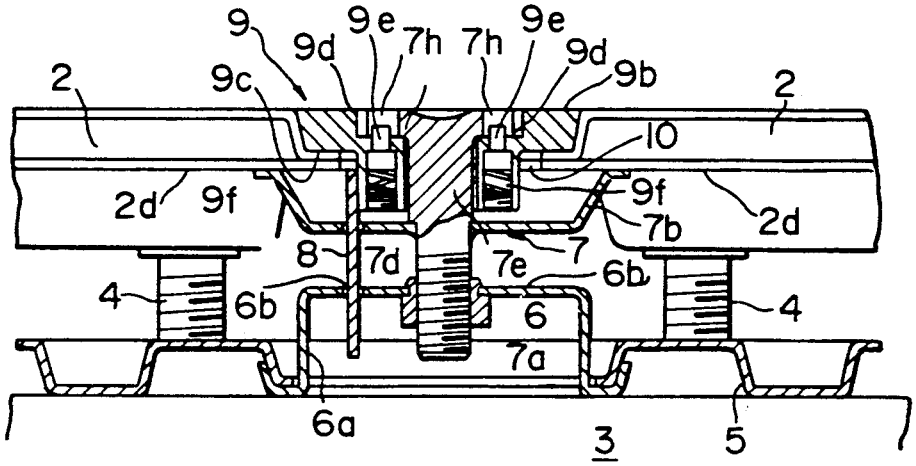
FIG. 16 is a cross-sectional view illustrating the device of FIG. 12 in an assembled condition.

The retainer plate 5 is of a circular configuration and is formed with a recessed groove 5*a* of a ring-like shape at the upper periphery thereof. A retainer plate 5 in the central portion of a free access floor 1 is positioned below a point where corner portions 2*a* of the adjacent four floor panels 2 meet. A retainer plate 5 at one side of the free access floor 1 adjacent to a wall is positioned below a point where corner portions 2*a* of the adjacent two floor panels 2 meet, as shown in FIG. 11.

The support member 6*a* has a channel-like cross section with a flat upper surface and is formed integrally with the retainer plate 5 at the central portion of the upper surface of the retainer plate 5. The support member 6*a* is formed with the threaded portion 6 including a nut in the central portion of the upper end of the support member.

The lower portion of the bearing member 7 is rotatably supported within the threaded portion 6 of the retainer plate and is formed by a bolt member 7*a* adapted to be threadingly engaged with the threaded portion 6. The middle portion of the bearing member 7 is formed with a bearing plate 7*b* adapted to engage with the lower surfaces of the floor panels. The bearing plate 7*b* is in the form of a circular dish, upwardly open and formed with a substantially horizontally oriented flange portion 7*c* at the periphery thereof. The flange portion 7*c* engages with the lower surfaces of the floor panels 2 so as to maintain the floor panels 2 at a level equal to that of the bearing member 7. The upper half of the bearing member 7 includes a columnar shaft portion 7*e* integral with the bolt member 7*a* and extending upwardly therefrom, and an enlarged engagement portion 7*f* at the upper end of the shaft portion 7*e* for engagement with the panel holder 9. The engagement portion 7*f* is formed, in the upper surface thereof, with a groove 7*g* for receiving a suitable tool, such as a screw driver, in order to facilitate rotational manipulation of the shaft portion 7*e*.

A plurality of engagement holes 6*b* for receiving therein a stopper 8 are formed in the upper flat portion of the support member 6*a*. A similar engagement hole 7*d* is formed in the bottom portion of the bearing plate 7*b*. The stopper 8 is in a plate-like form and is adapted to be detachably inserted into the engagement hole 7*d* formed in the bottom portion of the bearing plate and also into one of the engagement holes 6*b* in the upper portion of the support member 6*a*, the one of the engagement holes 6*b* being aligned with the engagement hole 7*d* of the bearing plate 7*b*. The stopper 8 thus prevents rotation of bearing member 7, which is rotatably mounted, so as to maintain the height or level of the bearing member 7 at a predetermined value. In this connection, it will be appreciated that insertion of the stopper 8 into any one of the adjacent engagement holes 6*b* would not cause any substantial difference in level of the bearing plate 7*b* of the bearing member 7.

The floor panels 2 are formed in a rectangular configuration. A support leg 4 is located adjacent each corner portion 2*a* of the floor panels 2 for vertically adjustable movement and extends downwardly from the floor panel. Each corner portion 2*a* is provided with a stepped portion 2*b* of a substantially quadrantal shape and a notch 2*c*. The lower surface of the corner portion 2a engages with the flange portion 7c of the bearing plate 7b.

Figure 5:
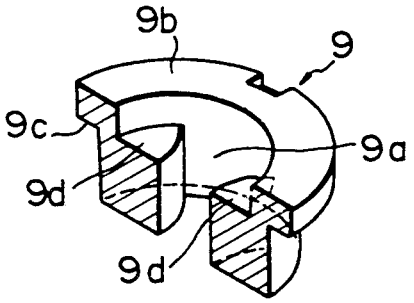
FIG. 5 is sectional perspective view along line A—A in FIG. 4.

The panel holder 9 is adapted to engage the bearing member 7 so as to fix the floor panel between them, and is formed as a hollow cylindrical member. The panel holder 9 includes a flange portion 9b at the upper end thereof. An annular shoulder portion 9c is formed in the lower surface of the flange portion 9b. An insert bore 9a of the panel holder 9 includes therein a pair of opposite inner flanges 9d, as best shown in FIG. 5.

The panel holder 9 is inserted into a through hole 10 which is defined by the four corner portions 2a, i.e., a space defined by the four notches 2c. The panel holder 9 is thus inserted into the through hole 10, the bearing member 7 is inserted into the insert bore 9a and engaged together with the annular shoulder portion 9c engaging with the stepped portions 2b of the floor panels 2 and the inner flange portion 9d urging against the lower surface of the engagement portion 7f of the bearing member 7. Thus, the panel holder 9 tightly fixes the corner portions 2a of the floor panels.

When fastening the panel holder 2 as mentioned above, the stepped portions 2b of the floor panels and the bearing plate 7b of the bearing member 7 are both resiliently deformed. Due to a resilient force resulting from the above resilient deformation, the floor panels 2 are firmly fixed between the bearing plate 7b of the bearing member 7 and the panel holder 9 and therefore the floor panels 2 are prevented from shaking or becoming displaced.

Further, the bearing member 7 is so designed as to be upwardly displaced when the panel holder is tightened, so that a resilient force may result from a resilient deformation of the support member 6a. Accordingly, the floor panels 2 are urged downwardly by means of the panel holder 9, whereby sideways movement or floating movement of the panels can be prevented.

A procedure of assembling a free access floor 1 will be explained hereinbelow with reference to FIGS. 1 to 5 and FIG. 11. The retainer plate 5 is first secured to a desired position on the surface of the base floor 3 by means of adhesive, for example, with the bearing member 7 positioned below a level at which the floor panels will be located in order to prevent the bearing member 7 from interfering with future installation of the floor panels. Then, the floor panels 2 are installed, with the lower end 4a of each of the support legs 4 being received in the respective recessed grooves 5a. The support leg 4 is then rotated by a screw driver, with the tip thereof inserted in a groove 4b at the upper end of the support leg, so as to adjust the level of the floor panels to a desired position. Then, a tool is inserted through the through hole 10 defined by the four corner portions 2a so as to engage the tip of the tool with the groove 7g of the bearing member 7. The bearing member 7 will be angularly rotated by the tool until the flange portion 7c thereof engages with the lower surface of the floor panel 2. Then, the stopper 8 is inserted through the through hole 10 downwardly from the floor panel 2 so as to be inserted into the engagement hole 7d and one of the engagement holes 6b and is retained therein so as to prevent rotation of the bearing member 7.

Alternatively, a level or height of the floor panels 2 can be adjusted by positioning the bearing member 7 at a predetermined level, while preventing rotation of the bearing member by means of the stopper 8. Then, the floor panels 2 are installed and the support legs 4 are rotated until the lower surface each of the floor panels abuts against the bearing plate 7b, whereby level adjustment of the floor panels can be achieved.

Then the panel holder 9 is inserted through the through hole 10 and is rotated by a predetermined amount (approximately 90 degrees), the engagement portion 7f of the bearing member 7 having passed through the insert hole 9a and the inner flange portions 9d of the panel holder 9 are pressingly engaged together. Thus, the panel holder 9 can be easily secured to the bearing member 7 by one touch manipulation so as to securely fix the floor panels 2.

FIGS. 6 to 10 illustrate other embodiments of the invention.

Figure 6:
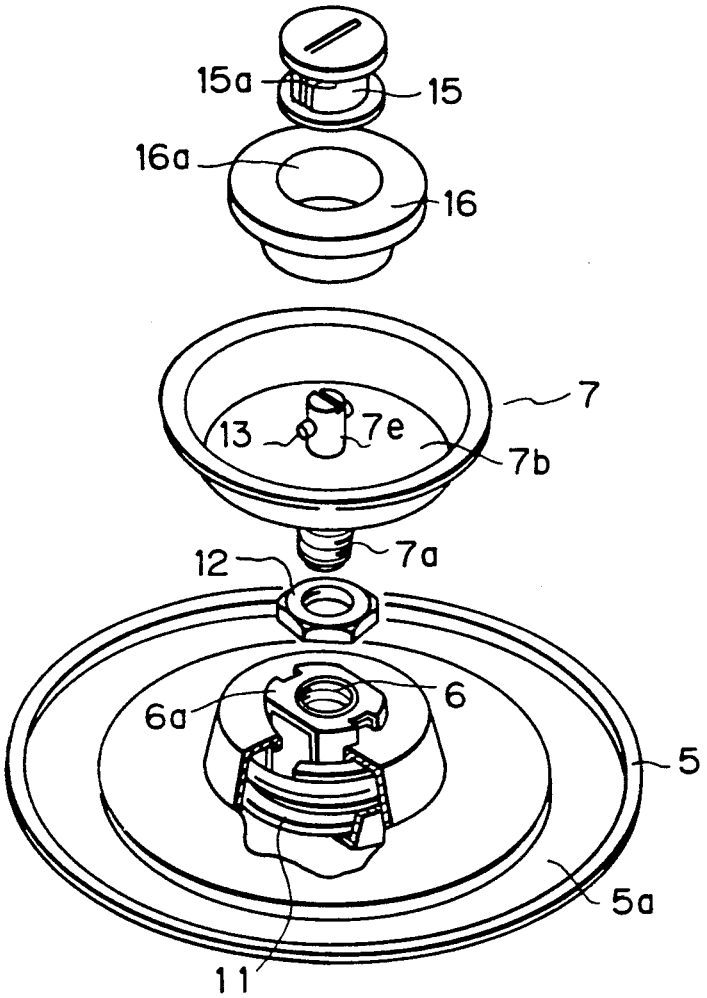
FIG. 6 is an exploded perspective view illustrating a floor panel fixing device according to a second embodiment of the invention.
Figure 7:
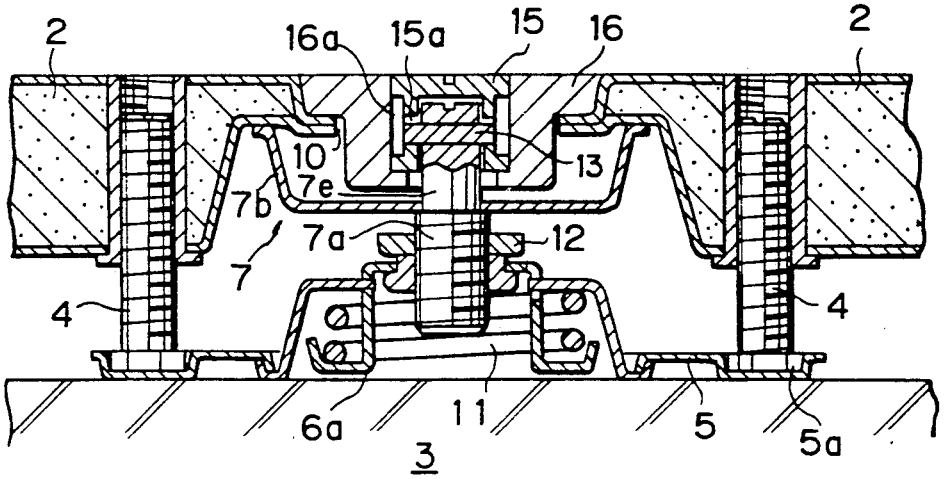
FIG. 7 is a cross-sectional view illustrating the device of FIG. 6 in an assembled condition.

According to a second embodiment of the invention shown in FIGS. 6 and 7, the retainer plate 5 and the support member 6a, which are fixed together according to the first embodiment shown above, are configured so that they are movable in a vertical direction relative to one another, with a spring 11 interposed therebetween. The spring 11 is arranged so as to be compressed when the support member 6a is displaced upwardly. A panel holder 14 of this embodiment includes a cap 15 and a holder member 16. A nut 12 is threaded onto the bolt 7a of the bearing member 7, which nut 12 serves to prevent the bearing member 7 from rotating after vertical or level adjustment of the bearing member has been completed. The shaft portion 7e defining the upper half of the bearing member 7 is provided in the upper periphery thereof with a protuberance 13 adapted to be engaged within a guide groove 15a in the cap 15.

When assembling a free access floor 1 by means of the device of the second embodiment according to the invention, the bearing plate 7b of the bearing member 7 is first positioned at a predetermined level or vertical position and is thereafter locked in that position by means of the nut 12 threaded onto the bolt 7a. Then, the floor panels 2 are installed in position, with support legs 4 thereof engaging in the recessed groove 5a of the retainer plate 5. The support legs 4 will be rotated to a level adjustment of the floor panels in a manner similar to that performed in the assembly of the first embodiment. The holder member 16 is inserted into the through hole 10, and then the cap 15 is also inserted into an insert bore 16a of the holder member 16. The floor panels 2 are clamped together by fitting the protuberance 13 of the bearing member into the guide groove 15 of the cap 15.

When assembled as shown above, the bearing member 7 and the support member 6a are displaced upwardly, thereby causing compression of the spring 11. The resultant spring or resilient force of the spring 11 causes the panel holder to urge the floor panels 2 in the downward direction, thereby preventing sideward shift or floating-up movement of the floor panels 2.

Figure 8:
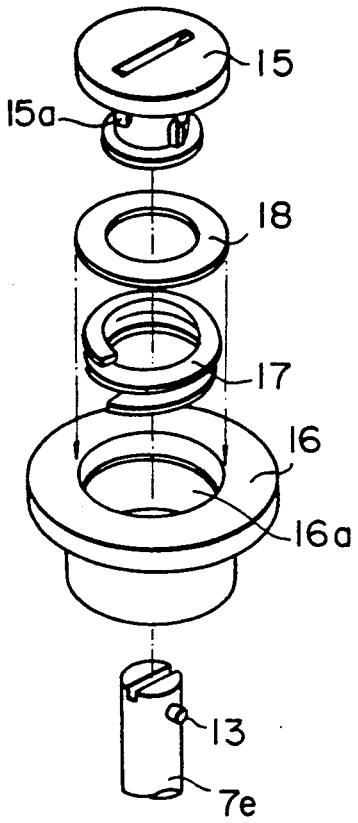
FIG. 8 is an exploded perspective view illustrating a floor panel fixing device according to a third embodiment of the invention.
Figure 9:
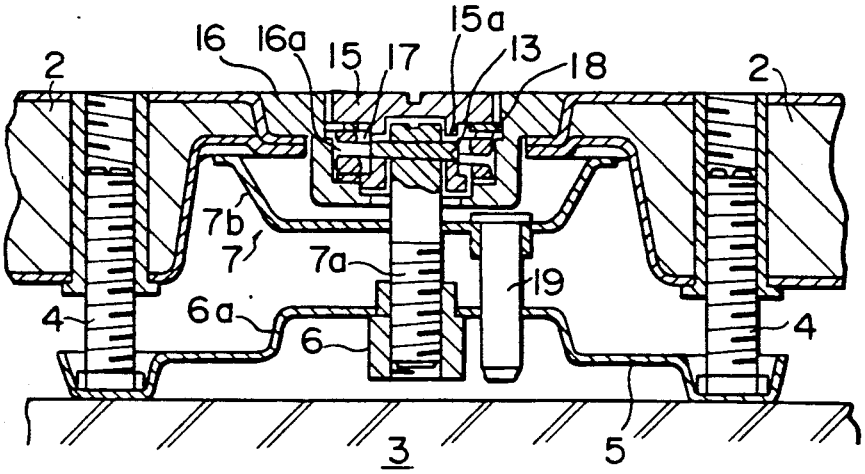
FIG. 9 is a cross-sectional view illustrating the device of FIG. 8 in assembled condition.

According to a third embodiment of the invention as shown in FIGS. 8 and 9, a spring 17 is interposed between the holder member 16 and the cap 15. The spring 17 may be compressed when the cap 15 is inserted into the insert bore 16a of the holder member 16 with the protuberance 13 fitted into the guide groove 15a. Thus, the fastening force exerted by the cap are enhanced so that the floor panels 2 is urged downwardly to be securely fixed to the surface of the base floor 3. In the drawings, reference numeral 18 designates a washer which increases the sliding characteristic of the cap 15, while preventing the cap 15 from being damaged by the spring 17 upon rotation thereof. A columnar pin 19 is simultaneously inserted through the retainer plate 5 and bearing member 7 in order to prevent rotation of the bearing member 7.

Figure 10:
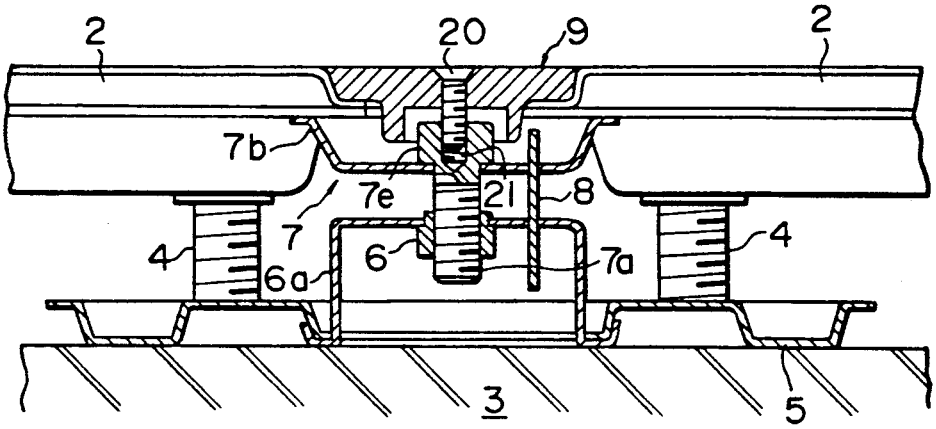
FIG. 10 is a cross-sectional view illustrating a floor panel fixing device according to a fourth embodiment of the invention in an assembled condition.

According to a fourth embodiment of the invention as shown in FIG. 10, the shaft portion 7e of the bearing member 7 is formed with an internally threaded portion 21 extending substantially along the longitudinal axis thereof. As shown in FIG. 10, a machine screw 20 is screwed into the threaded portion 21 so as to tightly fasten the panel holder 9. It will be appreciated that the above construction in which the panel holder 9 is locked by means of the machine screw permits the floor panels to be firmly secured together. Further, provision of the bearing member 7 contributes to a reduction in the length of the threaded portion of the machine screw 20 to be tightened, thus improving its operational characteristics. The remaining portions or components of this embodiment and the operation thereof, other than specifically referred to in the above, are substantially similar to those of the first embodiment.

As explained above, in accordance with the floor panel fixing device according to the first to fourth embodiment of the invention, the floor panels can be firmly secured together between the bearing member and the panel holder at the location where corner portions of adjacent floor panels each having a support leg integral therewith meet. Additionally, the floor panels are urged downwardly due to a resilient force resulting from resilient deformation of the support member, thereby preventing sideways or floating movement of the floor panels, whereby a free access floor construction having superior antivibration properties can be obtained.

Furthermore, operation of the level adjustment for the support legs and panel holder, as well as attachment of the panel holder, can be performed on the floor panels. Additionally, a procedure for securing or fixing the floor panels can be conducted by one touch manipulation. Accordingly, the present invention facilitates installation and maintains operations.

FIGS. 12 through 17 show a fifth embodiment of the invention. It is to be noted that the portions or components or the operations of this embodiment, as well as several other embodiments which will be explained later, other than those specifically referred to hereinbelow, are similar to those of the first to fourth embodiment shown above, and details of which are therefore omitted in order to avoid repetition.

The flange portion 7c engages the lower surfaces of the floor panels 2 so as to maintain the floor panels 2 at a level equal to that of the bearing member 7. The upper half of the bearing member 7 includes a columnar shaft portion 7e integral with the bolt member 7a and extending upwardly therefrom, and an enlarged engagement portion 7f at the upper end of the shaft portion 7e for engagement with the panel holder 9. The engagement portion 7f is formed with a pair of notches 7h adapted to engage with pins 9e of the panel holder 9. The engagement portion 7f is also formed in the upper surface thereof with a groove 7g for receiving a suitable tool, such as a screw driver, in order to facilitate rotational manipulation of the shaft portion 7e.

The panel holder 9 is adapted to engage the bearing member 7 so as to fix the floor panels between them and is formed as a hollow cylindrical member. The panel holder 9 includes a flange portion 9b at the upper end thereof. An annular shoulder portion 9c is formed at the lower surface of the flange portion 9b. An insert bore 9a of the panel holder 9 includes therein a pair of opposite inner flanges 9d. Each inner flange 9d is formed with a columnar pin 9e extending upwardly from the upper surface thereof. Each pin 9e is supported by a spring 9f so that it is displaceable in the vertical direction and, when depressed, it moves downwardly into the inner flange 9d until its upper end becomes flush with the upper surface of the inner flange 9d.

The panel holder 9 is inserted into a through hole 10 which is defined by the four corner portions 2a, i.e., the space defined by the four notches 2c. The panel holder 9 thus inserted into the through hole 10 and the bearing member 7 inserted into the insert bore 9a are engaged together with the annular shoulder portion 9c engaging with the stepped portions 2b of the floor panels 2 and the inner flange portion 9d urging against the lower surface of the engagement portion 7f of the bearing member 7. Further, the notches 7h formed on the engagement portion 7f are engaged with the respective pins 9e protruding from the inner flanges 9d. Thus, the panel holder 9 is securely fixed to the bearing member 7.

A procedure of assembling a free access floor 1 will be explained hereinbelow with reference to FIGS. 12 to 17. The retainer plate 5 is first secured to a desired position on the surface of the base floor 3 by means of adhesive, for example, with the bearing member 7 positioned below a level at which the floor panels will be located in order to prevent the bearing member 7 from interfering with future installation of the floor panels. Then, the floor panels 2 are installed, with the lower end 4a each of the support legs 4 received in the respective recessed grooves 5a. The support leg 4 is then rotated by a screw driver, with the tip thereof inserted in a groove 4b at the upper end of the support leg, so as to adjust the level of the floor panels to a desired position. Then, a tool is inserted through the through hole 10 defined by the four corner portions 2a, and the tip of the tool is engaged with the groove 7g of the bearing member 7. The bearing member 7 is angularly rotated by the tool until the flange portion 7c thereof engages with the lower surface of the floor panel 2. Then, the stopper 8 is inserted through the through hole 10 downwardly from the floor panel 2 so that the stopper 8 is inserted into the engagement hole 7d and one of the engagement holes 6b and is retained therein so as to prevent rotation of the bearing member 7. Alternatively, the level or height of the floor panels 2 can be adjusted by positioning the bearing member 7 at a predetermined level, while preventing rotation of the bearing member by means of the stopper 8. Then, the floor panels 2 are installed and the support legs 4 are rotated until the lower surface each of the floor panels abuts against the bearing plate 7b, whereby level adjustment of the floor panels can be achieved.

Next, the panel holder 9 is inserted into the through hole 10 and a special tool 30 is engaged with the panel holder 9, which tool 30 is specifically designed for facilitating the engagement and disengagement procedure of the panel holder 9 relative to the bearing member 7. The tool 30 includes a pair of opposed L-shaped protrusions 31 and a pair of opposed insert portions 32, both extending from the bottom surface of the tool 30. Each L-shaped protrusion 31 is so designed that it downwardly displaces the pin 9e of the panel holder 9 so as to be able to rotate below the lower surface of the engagement portion 7f. The insert portions 32 are designed to be engaged within respective openings 9g of the panel holder. When the panel holder 9, with the pins 9e thereof being depressed to the lowest position, is rotated by a predetermined amount (approximately 90 degrees), the engagement portion *7f* of the bearing member 7, having been inserted through the insert bore *9a*, and the inner flanges *9d* engage together in a press-fit manner. Upon detachment of the tool 30 from the panel holder 9, the pins *9e* engage within the respective notches *7h* in the engagement portion *7f* of the bearing member 7. Thus, the panel holder 9 is easily locked at its non-rotative, fixed state by one touch manipulation. Furthermore, the panel holder 9 can be easily removed from the bearing member 7 by means of the tool 30 by one touch manipulation, wherein the panel holder 9, with the pins *9e* thereof being in a depressed state, is rotated by a predetermined amount (approximately 90 degrees).

Figure 17:
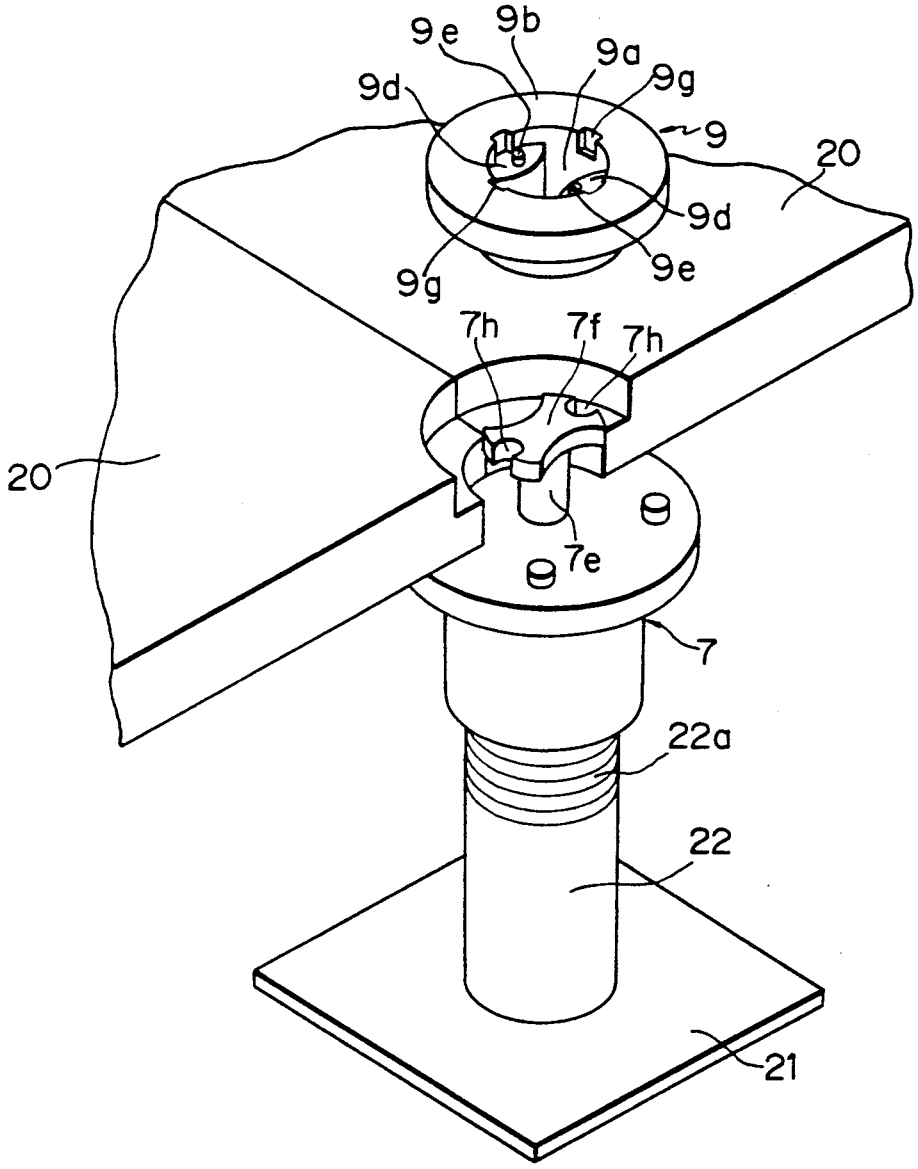
FIG. 17 is an exploded perspective view illustrating a floor panel fixing device according to a sixth embodiment of the invention.
Figure 18:
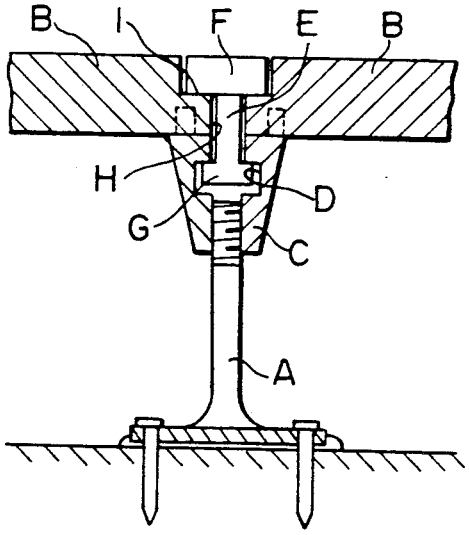
Fig. 18 PRIOR ART
FIG. 18 a partial cross-sectional view illustrating prior art floor panel fixing device.

FIG. 17 shows a sixth embodiment of the invention. A floor panel fixing device according to this embodiment includes a base plate 21, a columnar leg 22 extending upwardly from the base plate 21 and having an externally threaded portion *22a* at the upper end thereof, and a bearing member 7 adapted to threadingly engage with the columnar leg 22 at one end thereof. Thus, the device of this embodiment is intended to support floor panels 20 which are not provided with any support legs. The construction and operation in which the panel holder 9 and the bearing member 7 are engaged with each other are similar to those of the above fifth embodiment.

According to the fifth and sixth embodiment of the invention, the floor panels 2 are prevented from being unrestrictedly opened or closed without the provision of any special defensive means. This contributes to avoiding electric cables and/or equipment located below the floor panels from being intentionally injured or damaged. Additionally, each corner portion of the adjacent four floor panels can be locked together by means of a single panel holder, thus greatly contributing to cost saving and improvement of working properties. Further, a conventional free access floor and a free access floor in which unobstructed or free open/close manipulation is prevented can optionally and easily be obtained simply by selecting a conventional panel holder or a panel holder having the above pins.

The procedure required for fixing the floor panels by means of the above device is similar to a conventional procedure, thereby giving no significant affection to working properties. Maintenance work can also be easily carried out.

Furthermore, as the panel holder is locked in a nonrotational, fixed state, the floor panels are prevented from being loosened or detached due to vibration, and are firmly secured in position without any free movement.

What is claimed is:

1. A device for fixing floor panels to be mounted on a surface of a base floor by means of support legs which permit vertical adjustment of the floor panels, comprising:

a retainer plate fixed to the base floor for receiving the support legs therein;

a support member extending vertically from said retainer plate and having an internally threaded portion;

a panel holder; and a bearing member for said panel holder, said bearing member having one end thereof threaded into said internally threaded portion of said support member for rotatable movement of said bearing member relative to said retainer plate, said bearing member being accessible through the floor panels for operation thereof;

said panel holder being adapted to be engageable with said bearing member for fixing the floor panels.

2. The fixing device in accordance with claim 1, and further comprising a stopper for preventing rotation of said bearing member, said stopper being adapted to be engaged with said support member and said bearing member.

3. The fixing device in accordance with claim 1, wherein said panel holder is configured so as to be engaged with said bearing member at a single touch.

4. The fixing device in accordance with claim 1, wherein:

said bearing member comprises an annular bearing plate and a shaft portion extending therefrom having an engagement portion thereon for engagement by said panel holder; and said panel holder comprises a hollow cylindrical member having a flange portion for engagement with the floor panels and inner flanges for engagement with said engagement portion of said shaft portion of said bearing member.

5. The fixing device of claim 4, wherein:

said engagement portion has a pair of notches therein; and said inner flanges have pins therein for engagement with said notches of said engagement portion.

6. The fixing device of claim 5, wherein:

said pins are resiliently moveably mounted in said inner flanges.

7. The fixing device of claim 1, wherein:

said retainer plate has a groove therein for receiving the support legs.

8. The fixing device of claim 1, wherein:

said support member is vertically moveably mounted to said retainer plate and biased downwardly by a compression spring therebetween.

9. The fixing device of claim 1, wherein:

said bearing member comprises an annular bearing plate and a shaft portion extending therefrom having an engagement portion thereon for engagement by said panel holder, said engagement portion including a protuberance; and said panel holder comprises a hollow cylindrical member having a flange portion for engagement with the floor panels and a cap to be fitted therein having a guide groove for engagement with said protuberance.

10. The fixing device of claim 9, and further comprising a spring in said panel holder for upwardly biasing said cap.

11. The fixing device of claim 1, wherein:

said bearing member comprises an annular bearing plate and a shaft portion extending therefrom having an engagement portion thereon for engagement by said panel holder, said engagement portion comprising an upwardly directed internal thread; and said panel holder comprises a hollow cylindrical member having a flange portion for engagement with the floor panels and a screw for engaging said engagement portion of said bearing member.

* * * * *